US005792224A

United States Patent [19]

Fu et al.

[11] Patent Number: 5,792,224

[45] Date of Patent: Aug. 11, 1998

[54] CONNECTOR SYSTEM

[75] Inventors: Shuzhen Fu, Strongsville; John J. Andrisin, Jr., Parma; John R. Lackner, Strongsville, all of Ohio

[73] Assignee: The Scott Fetzer Company, Westlake, Ohio

[21] Appl. No.: 789,309

[22] Filed: Jan. 23, 1997

[51] Int. Cl.[6] ..... B01D 46/02

[52] U.S. Cl. ..... 55/375; 55/377; 55/378; 55/DIG. 2; 55/DIG. 3; 15/349; 15/351

[58] Field of Search ..... 55/357, 369, 374, 55/375, 376, 377, 378, DIG. 2, DIG. 3, DIG. 26; 15/349, 351, 352

[56] References Cited

U.S. PATENT DOCUMENTS

| | | | |
|---|---|---|---|
| 2,719,597 | 10/1955 | Braze | 55/375 |
| 3,933,451 | 1/1976 | Johansson | 55/DIG. 2 |
| 4,262,384 | 4/1981 | Bowers | 55/375 |
| 4,274,847 | 6/1981 | Crener | 55/378 |
| 4,877,432 | 10/1989 | Lackner . | |
| 5,064,455 | 11/1991 | Lackner . | |

FOREIGN PATENT DOCUMENTS

| | | | |
|---|---|---|---|
| 1519143 | 2/1968 | France | 55/377 |
| 562142 | 6/1944 | United Kingdom | 55/375 |
| 2033248 | 5/1980 | United Kingdom | 55/377 |

*Primary Examiner*—Jay H. Woo
*Assistant Examiner*—Minh-Chaut T. Pham
*Attorney, Agent, or Firm*—Jones, Day, Reavis & Pogue

[57] ABSTRACT

A connector system is disclosed for providing a connection between a tubular connector having external projections and a mounting collar having a hole with internal notches, for receiving the projections and securing them upon rotation. The connector opening has a non-planar edge and the collar includes an elastic sealing diaphragm with an elongated hole. This configuration of elements cooperate to reduce full contact between the diaphragm and connector during installation, permitting less force to be used in bringing the components into full connection and also providing a spring force which facilitates removal. Also disclosed is a bag for receiving a connector portion. The bag has a continuous perforation, approximately dimensioned to correspond to the connector portion's opening. The perforation is separated by contact with the connector, so as to admit the connector into the filter bag.

12 Claims, 3 Drawing Sheets

CONNECTOR SYSTEM

The present invention relates to the field of connector systems for providing a fluid-seal between two fluid-conducting members. In particular, the present invention is useful as a connector between a hose and a filter bag in a vacuum cleaner.

Fluid-tight connectors for vacuum cleaner filter bags are known. Connectors of this type are shown in U.S. Pat. Nos. 4,877,432 and 5,064,455, assigned to the present assignee, the disclosures of which are hereby incorporated by reference.

As shown in FIG. 1, this connector design incorporates a rigid mounting collar 10 which mounts to a cylindrical connector 12. The connector 12 is a tube with projections 14 which lock it onto the collar 10. The collar 10 is a frame having a hole 16 with outwardly extending portions (i.e. notches 18) to receive the projections 14. The hole 16 is covered by an elastic diaphragm 20, which has a generally circular opening 22. The diaphragm 20 engages the sealing surface of the connector 12 and extends over a portion of the projections 14. The entire collar 10 assembly is mounted on a vacuum cleaner bag 24.

The projections 14 are inserted into the notches 18 and the connector 12 and the collar 10 are rotated with respect to each other so that the projections 14 lock onto the collar 10 to prevent it from slipping off. The diaphragm opening 22 wraps tightly around the connector 12 to prevent particle-laden air from escaping between the collar 10 and the connector 12.

In order to assure a good fluid seal around the connector, the diaphragm must provide sufficient coverage over the connector's surface, and sufficient tightness of contact (as shown in FIG. 2A). However, applicants have observed that the friction and tensile force resulting from sufficient coverage and thickness for a good air seal renders the collar difficult to push onto the connector and rotate with respect to each other. As shown in FIG. 2B, there is a tendency for the diaphragm 20 to fold over onto itself during disconnection, making separation of the connector 12 difficult. These factors may pose a problem for elderly or disabled users who may lack hand strength.

As shown in FIG. 5, previous-style vacuum cleaner bags typically include a number of radially-extending perforations 26, which are separated upon initial insertion of the connector 12 into the collar 10. These perforations do not easily separate, however, since the connector 12 applies a force which is transverse to the direction of separation. Thus, a large force is necessary to insert the connector 12 into the bag, which may also pose a problem for elderly or disabled users.

SUMMARY OF THE INVENTION

In view of the above-indicated drawbacks with previous systems, there is therefore a need for a connector which preserves the air seal qualities of the previous connector systems, while providing improved ease of insertion and rotation during connection and disconnection.

There is also a need for a diaphragm member which does not fold over onto itself during disconnection.

The above needs are satisfied by the present invention in which the connector has a nonplanar edge and the diaphragm includes on elongated hole. These elements cooperate to reduce full contact between the diaphragm and the connector during installation, permitting less force to be used to bring the components into full connection while providing greater ease of disconnection.

As will be appreciated, the invention is capable of other and different embodiments, and its several details are capable of modifications in various respects all without departing from the invention. Accordingly, the drawings and description are to be regarded as illustrative and not restrictive.

BRIEF DESCRIPTION OF THE DRAWINGS

The embodiment of the invention will now be described by way of example only, with reference to the accompanying figures wherein the members bear like reference to like numerals and wherein.

DETAILED DESCRIPTION OF THE INVENTION

Referring now to FIGS. 3A–D and 4A–B, which are the purposes of illustrating only the preferred embodiment of the present invention and not for purposes of limiting the same, a rigid mounting collar 30 is provided which mounts to a cylindrical connector 32, for connecting a respective hose or conduit (preferably from a flow conducting member such as a vacuum cleaner nozzle or fan exhaust) to a receiving portion (preferably a vacuum cleaner bag 54) for continuously conducting a fluid therethrough.

Figure 1:
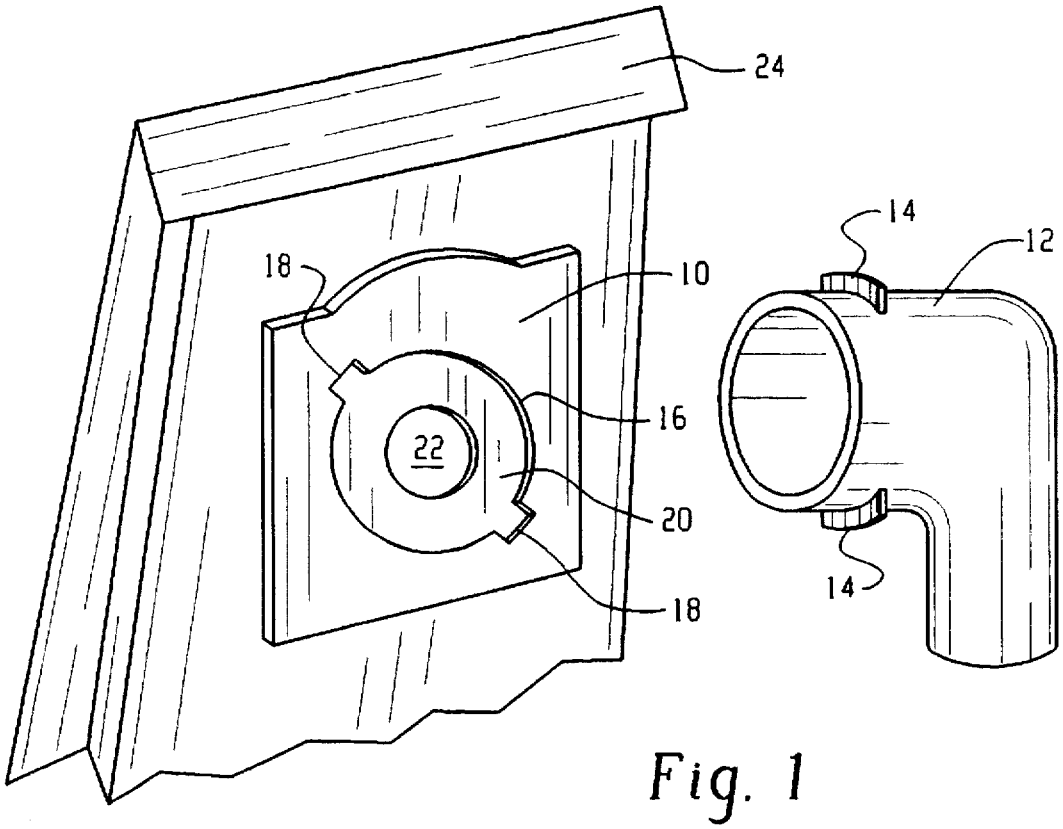
Fig. 1 PRIOR ART
FIG. 1 is a perspective view showing a previous collar and connector design.
Figure 2A:
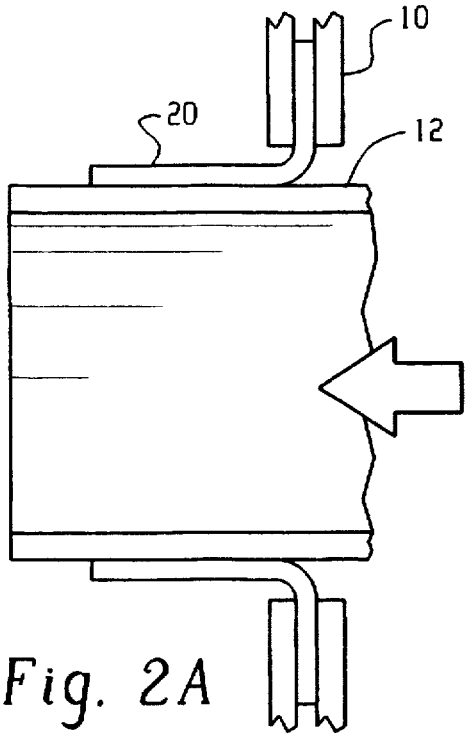
Fig. 2A PRIOR ART
FIGS. 2A and 2B are side-sectional views respectively showing the interaction between the connector and diaphragm of the previous design.
Figure 2B:
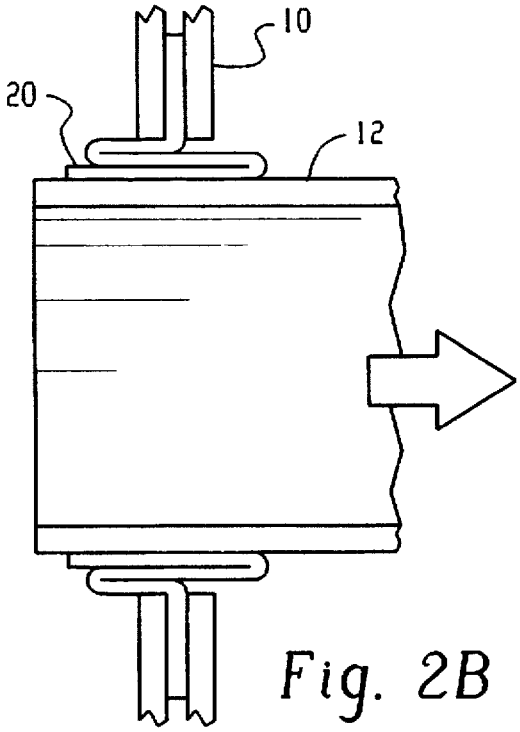
Fig. 2B PRIOR ART
Figure 3A:
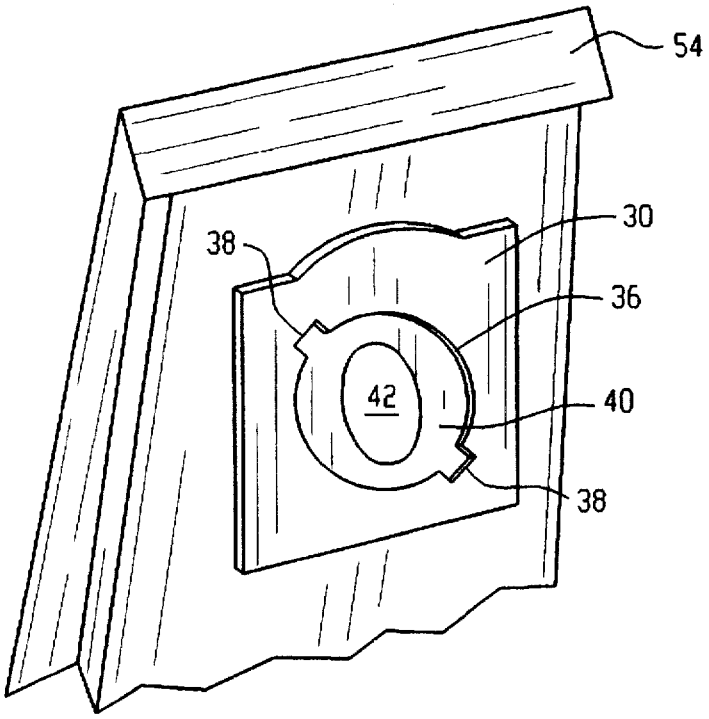
FIGS. 3A, 3B, 3C and 3D are views showing the various features and embodiments of the collar and connector as according to the present invention.
Figure 3B:
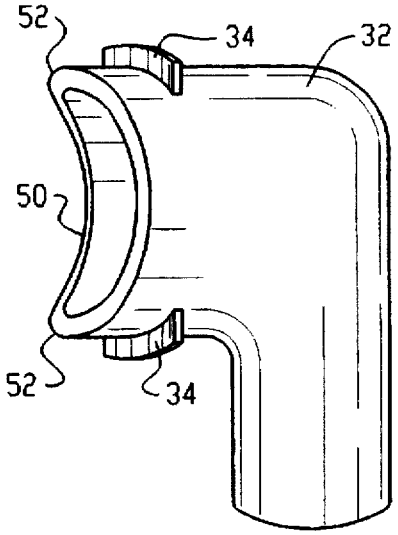
Figure 3D:
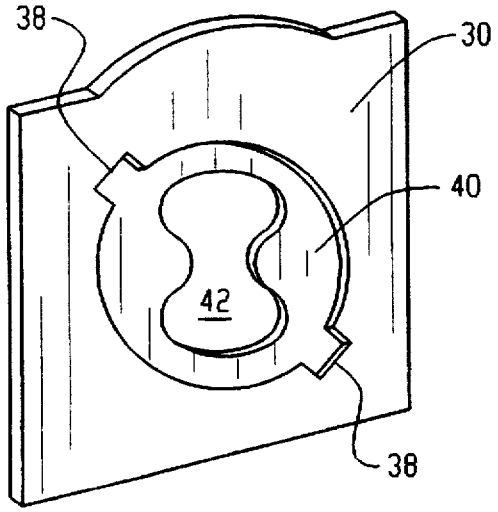
Figure 3C:
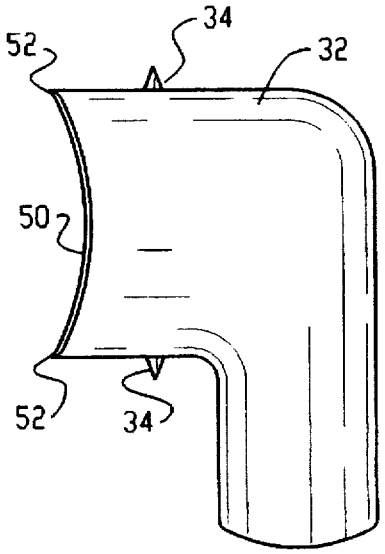
Figure 4A:
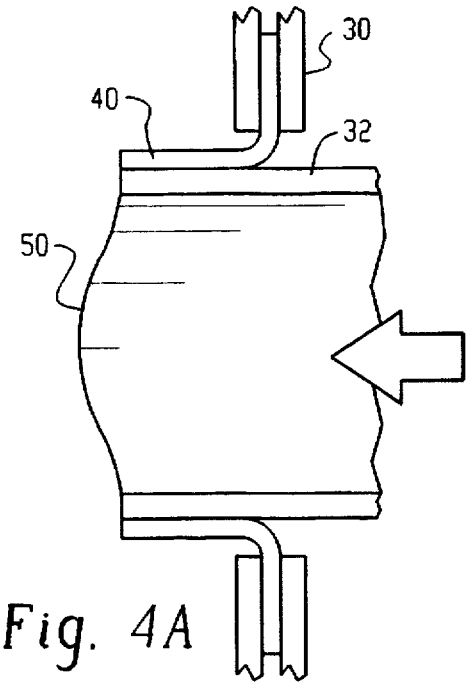
FIGS. 4A and 4B are side-sectional views showing the interaction between the connector and diaphragm as according to the present invention.
Figure 4B:
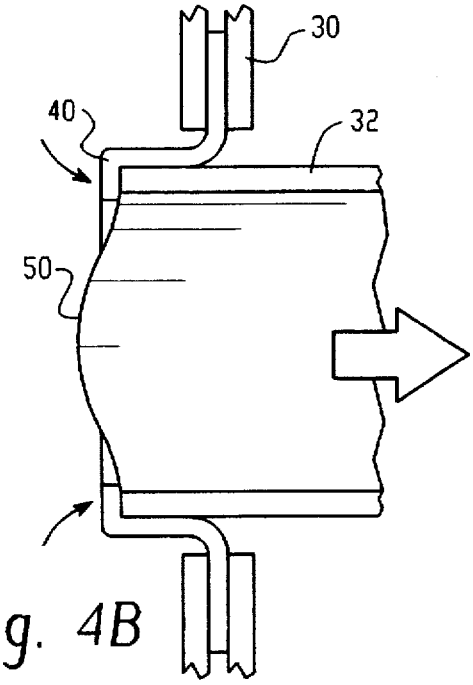
Figure 5:
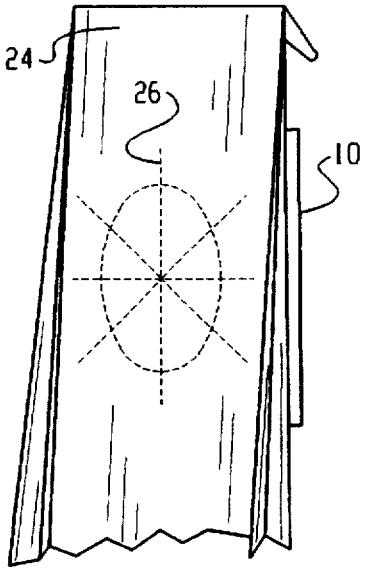
Fig. 5 PRIOR ART
FIG. 5 is an internal view showing a bag with perforation as according to a previous design.

The connector 32 is preferably a hollow tube with one or more projections 34 to lock it onto the collar 30. The collar 30 includes a frame and has a hole 36 with outwardly extending notches 38 to receive the projections 34. The connector 32 can be secured to the collar 30 through other connection devices such as e.g. a biasing member which inclines the connector 32 into engagement with the collar 30. The hole 36 is covered by an elastic diaphragm 40 having a substantially elongated opening 42 which is preferably elliptical or oval-shaped (as shown in FIG. 3A) or alternatively "peanut" shaped (as shown in FIG. 3D). The diaphragm 40 engages the sealing surface and extends over a portion of the projections 34.

In the preferred embodiment, the projections 34 are inserted into the notches 38 from a facing side of the collar 30, and the collar 30 and connector 32 are rotated with respect to one another so that the projections 34 lock onto the collar 30 to prevent it from slipping off. Either the connector 32 or the collar 30 can alternately be fixed to permit the respective other to rotate. The diaphragm opening 42 wraps tightly around the connector 32 to prevent air from escaping between the collar 30 and the connector 32.

In order to facilitate mounting, the connector opening 50 is scalloped, that is, made with a non-planar edge. Preferably, the scallop is a bevel with sides at a predetermined angle, preferably 90 degrees. Upon mounting, the connector 32 is inserted into the collar 30, and the "points" 52 of the scalloped connector opening 50 make contact with diaphragm 40, stretching the diaphragm 40 and causing the diaphragm edges near the longest diameter of the elongated hole 42 to slip over the opening. The remainder of the diaphragm edge follows upon further insertion so that only a small force is required to insert the connector 32 into the diaphragm 40.

Upon initial insertion, the perimeter of the connector 32 makes minimal contact with the diaphragm 40, and partially overlaps the opening 50. As the connector 32 and collar 30 are rotated, an increasing portion of the diaphragm periphery is brought into contact with the connector periphery. The diaphragm 40 thus increasingly seals around the periphery of the connector 32, becoming maximum at the point of proper alignment. These design elements cooperate to reduce full contact during installation, permitting reduced force to be used in bringing the components into full connection.

During mounting, only a small force is needed to rotate the collar 30 and connector 32 into position, rather than a large force as required to overcome friction in the previous connector system. However, equivalent tightness and coverage is provided upon full contact, and so the air seal of the present invention is comparable to that of previous connector systems. This also assists in removal, as a small force is needed to rotate the elements for disconnection. Also, as a portion of the diaphragm 40 overlaps the opening 50 during removal, the diaphragm 40 applies a biasing spring force against the connector 32 which further facilitates disconnection, rather than folding over as did the previous connector system. In these ways, the present invention is easier to operate than previous connector systems and thus offers considerable advantages.

Figure 6:
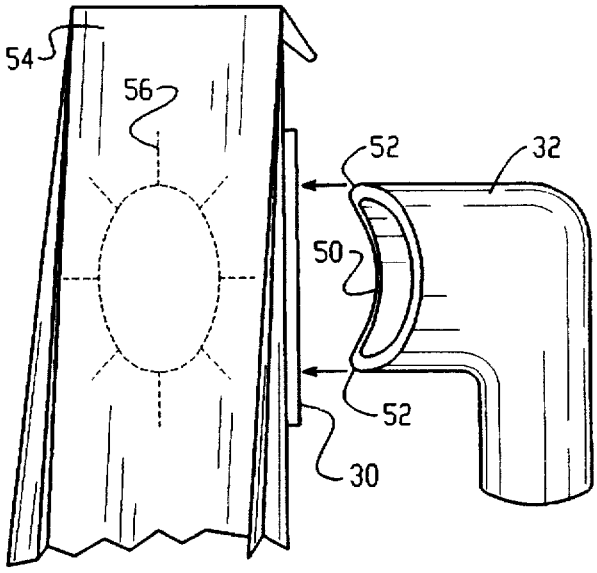
FIG. 6 is an internal view showing a bag with perforation as according to the present invention.

As seen in FIG. 6, the bag 54 of the present invention includes a number of perforations 56 comprising a continuous perforation, preferably annular in shape, with a plurality of radial perforations extending outwardly from the perimeter. The diameter of the annular perforation is substantially a comparable dimension with that of the connector opening 50. Upon insertion of the connector 32 into the bag 54, the points 52 of the connector opening make contact with the annular perforation, creating a highly-localized stress point, causing separation with only a small application of force. The radial perforations separate after connector insertion, to accommodate the connector 32 without tearing the bag.

As described hereinabove, the present invention solves many problems associated with previous connector systems and presents improved versatility and operability. However, it will be appreciated that various changes in the details, materials and arrangements of parts which have been herein described and illustrated in order to explain the nature of the invention may be made by those skilled in the art within the principle and scope of the invention as expressed in the appended claims.

We claim:

1. A connector system for providing a fluid-tight seal comprising:

an admitting portion for conducting a fluid; a receiving portion, in fluid connection with said admitting portion, for also conducting said fluid; connection means for fluidly-connecting the admitting portion and the receiving portion, said connection means comprising;

a connector, attached to one of the respective admitting portion and the receiving portion, having an opening with a beveled edge;

a collar, attached to the respective other of the hose portion and the receiving portion, wherein the collar includes:

a frame including means for securing the connector to the collar;

a flexible diaphragm in connection with the opposite side of the frame, for providing a fluid seal against the outside perimeter of the connector, wherein said diaphragm includes an elongated hole, which cooperates with said beveled edge to provide a variable sealing contact between the diaphragm and said connector, wherein said variable sealing contact creates a biasing force which assists in disconnection.

2. The connector system of claim 1 wherein the admitting portion is connected to flow conducting member of a vacuum cleaner and the receiving portion is a vacuum cleaner filter bag.

3. The connector system of claim 2 wherein the vacuum cleaner filter bag includes a continuous perforation, approximately dimensioned to correspond to the connector portion's opening, wherein the perforation is separated by contact with the connector, so as to admit the connector into the filter bag.

4. The connector system of claim 3 wherein the continuous perforation is annular, and further comprising a plurality of radially-extending perforations.

5. The connector system of claim 4 wherein the radially-extending perforations extend outwardly from the perimeter of the annular perforation.

6. The connector system of claim 1 wherein the elongated hole is oval-shaped.

7. The connector system of claim 6 wherein the bevel has sides at angle of 90 degrees.

8. The connector system of claim 1 wherein the elongated hole is "peanut" shaped.

9. The connector system of claim 1 wherein the connector includes at least one projection for securing the connector, and wherein the frame includes a facing side and an opposite side and a respective number of notches for receiving said at least one projection, wherein upon insertion of the at least one projection into the respective notches from the facing side, the connector and frame are rotated with respect to one another to retain said at least one projection on the opposite side.

10. A bag for receiving a connector portion, wherein the bag comprises a continuous perforation, approximately dimensioned to correspond to the connector portion's opening, wherein the perforation is separated by contact with the connector, so as to admit the connector into the filter bag.

11. The connector system of claim 10 wherein the continuous perforation is annular, and further comprising a plurality of radially-extending perforations.

12. The connector system of claim 11 wherein the radially-extending perforations extend outwardly from the perimeter of the annular perforation.

* * * * *